US007210324B2

(12) United States Patent
Bender et al.

(10) Patent No.: US 7,210,324 B2
(45) Date of Patent: May 1, 2007

(54) PROCESS AND APPARATUS FOR PRODUCING AN ORDERED PACKING

(75) Inventors: Peter Bender, München (DE); Harald Ranke, Pöcking (DE)

(73) Assignee: Linde Aktiengesellschaft, Wiesbaden (DE)

( * ) Notice: Subject to any disclaimer, the term of this patent is extended or adjusted under 35 U.S.C. 154(b) by 330 days.

(21) Appl. No.: 10/916,638

(22) Filed: Aug. 12, 2004

(65) Prior Publication Data

US 2005/0113236 A1 May 26, 2005

(30) Foreign Application Priority Data

Aug. 12, 2003 (DE) ..... 103 37 073

(51) Int. Cl.
*B21D 19/00* (2006.01)

(52) U.S. Cl. ..... 72/379.6; 72/385

(58) Field of Classification Search ..... 72/185, 72/379.6, 187, 385, 475, 412, 188
See application file for complete search history.

(56) References Cited

U.S. PATENT DOCUMENTS

| | | | | |
|---|---|---|---|---|
| 4,450,706 | A * | 5/1984 | Engelmohr | 72/385 |
| 5,138,861 | A * | 8/1992 | Wallis | 72/185 |
| 5,277,052 | A * | 1/1994 | Braunheim et al. | 72/414 |
| 5,632,934 | A | 5/1997 | Billingham et al. | |
| 5,921,109 | A | 7/1999 | Billingham et al. | |
| 6,101,841 | A | 8/2000 | Billingham et al. | |
| 6,357,113 | B1 * | 3/2002 | Williams | 29/890.034 |
| 6,427,985 | B1 * | 8/2002 | Kaibel et al. | 261/112.2 |
| 6,461,559 | B1 | 10/2002 | Baer | |
| 6,578,829 | B2 * | 6/2003 | Ender et al. | 261/112.2 |
| 7,024,907 | B2 * | 4/2006 | Beauvois et al. | 72/385 |
| 2002/0112811 | A1 | 8/2002 | Beauvois et al. | |

FOREIGN PATENT DOCUMENTS

| | | | |
|---|---|---|---|
| DE | 10008983 | | 8/2001 |
| EP | 0707885 | | 4/1996 |
| EP | 0992282 | | 4/2000 |
| EP | 1025985 | A1 * | 8/2000 |
| EP | 1044787 | | 10/2000 |

* cited by examiner

*Primary Examiner*—Dmitry Suhol
(74) *Attorney, Agent, or Firm*—Millin, White, Zelano & Branigan, P.C.

(57) ABSTRACT

The invention relates to a process and an apparatus for producing a profiled sheet, in which the sheet is provided with a corrugation which runs obliquely with respect to the edges of the sheet and has a substantially constant angle of inclination. At least one edge region of the sheet is deformed by means of a ram-like deformation tool (6) which is alternately brought into contact with the edge region and removed from the edge region.

19 Claims, 1 Drawing Sheet

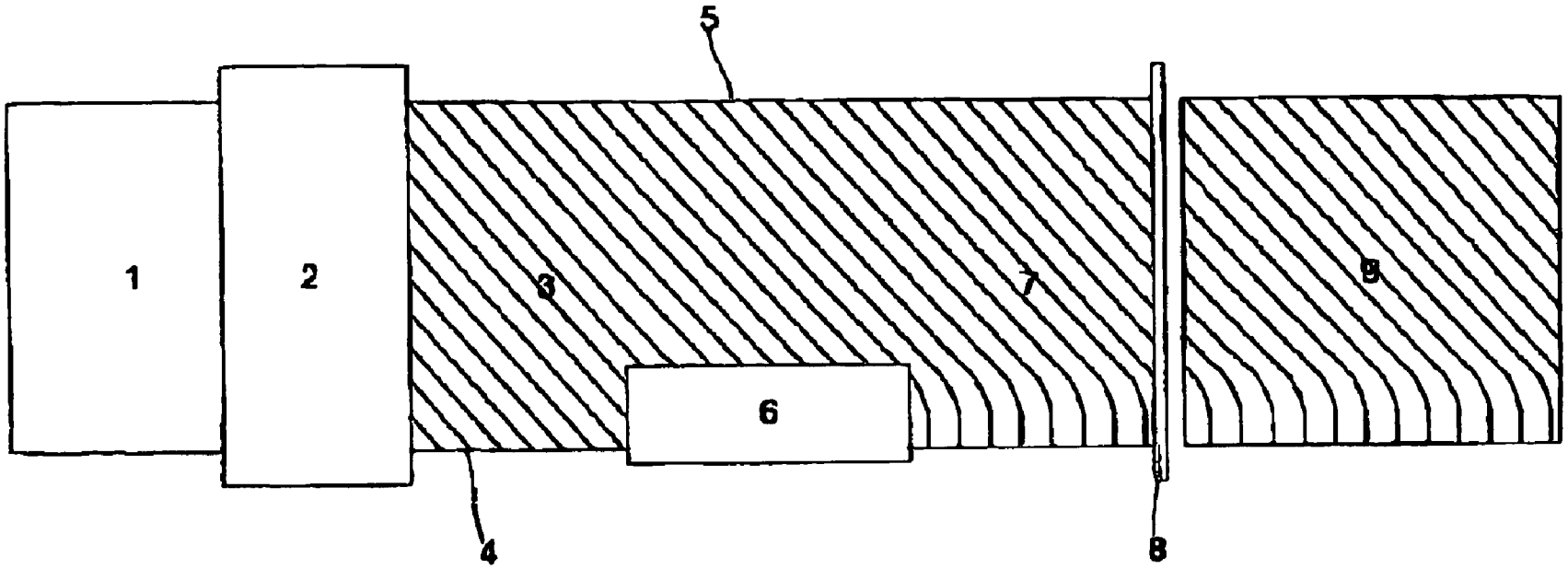
Fig.

PROCESS AND APPARATUS FOR PRODUCING AN ORDERED PACKING

The invention relates to a process for producing a profiled sheet, in which the sheet is provided with a corrugation which runs obliquely with respect to the edges of the sheet and has a substantially constant angle of inclination, and in which at least one edge region of the corrugated sheet is deformed. Furthermore, the invention relates to a process for producing an ordered packing, in which at least one edge region of a corrugated sheet is deformed, and a multiplicity of sheets which have been deformed in this manner are arranged parallel to one another. Moreover, the invention relates to a corresponding apparatus for producing a profiled sheet, having a first deformation unit, for providing the sheet with a corrugation, and having a second deformation unit, for deforming at least one edge region of the sheet.

Ordered packings are often used in separating columns for mass and/or heat transfer between two fluids. Packings of this type have a plurality of perpendicularly arranged metal packing sheets which at least in part have a corrugation running obliquely from the top downwards. In the text which follows, the term corrugation is to be understood as meaning any structure which is imparted to the metal packing sheet and forms flow channels for a liquid which is applied to the packing. Flow channels of this type can be produced by folding, creasing, bending the metal sheets or structuring them in some other way. The individual metal packing sheets are arranged next to one another within the packing, in such a way that the obliquely running flow channels of adjacent metal packing sheets cross one another.

It is known that the throughput in ordered packings of this type can be significantly increased by improving the drainage of liquid in the region of the lower edges of the metal packing sheets.

If a plurality of packings are arranged above one another, they are generally oriented in such a way, with a view to achieving a more uniform distribution of the liquid in the column, that their flow channels are in each case rotated through 90° with respect to one another. However, this has the drawback that the flow resistance for the gas flowing through the packing becomes particularly high at the location where two packings arranged above one another abut one another, since the gas flowing upwards out of the lower packing has to change direction into the new folded direction in order to enter the flow channels of the upper packing.

At the same time, the hydraulic cross section is significantly reduced at the location where the packings abut one another. On account of the interaction with the liquid which is running downwards, liquid builds up at the bottom edge of the top packing, narrowing the hydraulic cross section.

There are various known methods for alleviating these problems and increasing the capacity of an ordered packing. For example, it is proposed in EP 0 707 885 A1 to provide the upper or lower edge region of the metal packing sheets with perpendicular channels. Then, at the location where two packings arranged above one another abut one another, the gas flowing upwards does not have to change its direction of flow, or at least only has to do so to a lesser extent, and consequently the flow resistance is greatly reduced.

EP 1 044 787 B1 describes a process for producing a packing of this type, with the channels running perpendicularly at the boundary of the packing. A planar sheet strip is conveyed to a shaping unit and pleated, forming edges which have a constant angle of inclination with respect to the boundaries of the sheet strip. In a further shaping unit, in boundary zones of the sheet strip the edges are eliminated by plastic deformation by means of a pair of rolls and are simultaneously replaced by curved edges whose angles of inclination increase continuously from the central zone towards the boundaries of the sheet strip.

However, with the proposed process, it is only possible for two directly adjacent edges to be deformed in a deformation step. As soon as an edge formed during the deformation crosses an adjacent edge of the original sheet strip, a further deformation step is required. On account of the multiple deformation of the boundary region, it is difficult to maintain the original cycle rate of the production line.

US 2002/0112811 A1 has likewise disclosed a process for producing metal packing sheets which have a channel structure in which the channels in the upper and lower edge region of the metal packing sheet run perpendicularly, and between these regions they run obliquely, which respect to the upper and lower packing edges. In this process, a planar metal packing sheet is deformed in steps by two rams which move in an oscillating fashion relative to one another and each represent the desired modification to the metal packing sheet.

Since in this process the metal packing sheet is deformed over its entire width all at once, only a small number of channels can be produced in the metal packing sheet in one deformation step. Otherwise, the metal packing sheet would be excessively deformed. Therefore, a large number of deformation steps are required in order to provide the entire metal sheet with the channel structure.

Therefore, it is an object of the present invention to provide a process which allows corrugated metal packing sheets with a modified edge region and packings which have metal packing sheets of this type to be produced at approximately the same speed as conventional metal packing sheets or conventional packings without modifications. Furthermore, it is intended to provide an apparatus which is suitable for this purpose.

This object is achieved, according to the invention, by a process of the type described in the introduction, in which the edge region is deformed by means of a ram-like deformation tool which is alternately brought into contact with the edge region and removed from the edge region.

According to the invention, to produce an ordered packing, at least one edge region of a corrugated sheet is deformed by means of a ram-like deformation tool which is alternately brought into contact with the edge region and removed from the edge region, and a multiplicity of sheets which have been deformed in this manner are arranged parallel to one another. In this context, it has proved expedient first of all to deform the edge region of the sheet in accordance with the invention, and then to divide the sheet into individual partial pieces corresponding to the size of the desired packing element.

The partial piece is preferably removed at the same time as the deformation of the edge region of another piece of sheet. While the ram-like deformation tool is acting on a certain edge region of the sheet, at the same time another partial piece is being cut off the sheet. The fact that the deformation of the edge region takes place at the same time as the removal of a partial piece of the sheet which is in any case required, the time required for production in accordance with the invention is no greater, or only insignificantly greater, than the time required to produce a sheet without a deformed edge region.

An apparatus which is suitable in accordance with the invention for producing a profiled sheet has a first deformation unit, for providing the sheet with a corrugation, and a second deformation unit, for deforming at least one edge region of the sheet. According to the invention, the second deformation unit is designed as a ram-like deformation tool which is alternately brought into contact with the edge region and removed from the edge region.

The term edge region is to be understood as meaning a strip-like part of the sheet which runs parallel to an edge of the sheet. The size of the edge region may vary, but preferably takes up at most 10%, for preference at most 5%, of the sheet. The region of the sheet which lies between the two edge regions or, if just one edge region is to be deformed, the region between this edge region and the opposite edge of the sheet, is referred to as the main region.

In the text which follows, the terms "upwards" and "downwards" relate to the direction of flow of the liquid through the packing after it has been installed correctly in, for example, a mass transfer column. The upper edge region therefore extends along that edge of the metal packing sheet via which the liquid enters the flow channels formed by the metal sheets, and the lower edge region accordingly extends along that edge of the metal sheet via which the liquid leaves the flow channels again.

The invention is particularly suitable for the production of structured sheets of metal. For this reason, the terms "sheet" and "metal packing sheet" are in some cases used synonymously in the text which follows. However, such wording is not intended to represent any restriction of the invention to the structuring of metal sheets. The process according to the invention is equally suitable for the deformation of sheets made from other materials, for example plastic.

According to the invention, a profiled sheet, in particular a metal packing sheet for an ordered packing, is provided with a corrugation which runs obliquely with respect to the edges of the sheet and has a substantially constant angle of inclination with respect to the edges. It is preferable for the corrugation to continue into the edge regions of the sheet. However, it is also possible for only the main region of the sheet to be provided with the corrugation, and for the edge regions not to be structured in this process step.

At least one edge region of the corrugated sheet is deformed by means of a ram-like deformation tool. The deformation tool is designed as a type of ram and imparts the desired modification to the edge region of the sheet. The deformation tool is pressed onto the sheet, with the result that the structure of the sheet in the edge region is altered by the action of mechanical force. Then, the deformation tool is lifted off the sheet again, and the deformation tool and the sheet are moved relative to one another in the plane of the sheet, so that a further part of the sheet can be modified with the aid of the deformation tool.

The corrugated sheets with modified edge region that are produced in accordance with the invention, in order to produce an ordered packing, are arranged parallel to one another and are generally joined together. The individual sheets or metal packing sheets then have a main region with flow channels formed by the applied corrugation, and one or two edge regions in which the structure of the sheet deviates from the structure in the main region.

It is preferable for the corrugation in the main region, which has a substantially constant angle of inclination, also to be produced by means of a ram-like deformation tool. However, as an alternative to a ram-like deformation tool, it is also possible, analogously to the process described in EP 1 044 787 B1 as mentioned in the introduction, to use one or more profiled rolls which are rolled over the sheet used as starting material and in the process transfer the profile which is present on the rolls to the main region of the sheet.

Of the various options for modifying the edge region in order to reduce the flow resistance for the gas entering a packing layer, a modification to the angle of inclination of the corrugation has proven particularly suitable. It is preferable for the edge region to be deformed in such a way that in the edge region the angle of inclination of the corrugation with respect to the sheet edge delimiting the edge region is greater than the constant angle of inclination of the corrugation prior to the deformation. It is preferable for the angle of inclination of the corrugation in the edge region to amount to more than 80°, particularly preferably approximately 90°.

As has been mentioned in the introduction, it is often the case in a rectification column that a plurality of packing layers are arranged above one another, in which case an increased gas flow resistance occurs at the location where two packing layers abut one another. Therefore, in terms of fluid dynamics it is particularly expedient if both the adjacent edge regions of the metal packing sheets of two packing layers are deformed in accordance with the invention. By suitable deformation of the edge regions, it is possible to considerably reduce the resistance to the gas emerging from the channels formed by the corrugation in the lower packing layer and the gas entering the channels of the packing layer above.

On the other hand, in terms of manufacturing technology it is often more favourable for just one edge region of the sheet to be deformed in accordance with the invention. It has been found that the fluid-dynamic advantages can also be substantially achieved if just one, preferably the lower one, of two edge regions, which abut one another, of two packing layers is deformed in accordance with the invention.

It is advantageous for the sheet to be provided with a perforation and/or fine profiling prior to the deformation of the edge region, in order to increase the efficiency of the packing produced from the sheet.

According to the invention, the sheet or metal packing sheet is structured in two steps. First of all, a corrugation with channels running obliquely with respect to the sheet edge is applied over the entire width of the sheet or at least over the main region of the sheet. In a second step, at least one of the two edge regions, namely the upper and/or the lower edge region, is modified by means of a ram-like deformation tool.

The invention makes use of the possibility of using a ram-like deformation tool to deform a greater part of the sheet all at once. In theory, edge regions of any desired length can be deformed by means of a single ram-stamping operation. In practice, it is preferable to use rams which can deform the edge region over a length of between 0.5 and 1.5 m.

The risk of the sheet in the process being deformed excessively, in an unintended way, is combated by the sheet not being deformed over its entire width, but rather only in an edge region. The invention therefore allows defined structuring of the sheet, in particular defined deformation of at least an edge region of the sheet, with a high cycle rate.

It is advantageous for the sheet to pass through a first deformation unit, in which the sheet is provided with the corrugation, and for the edge region or regions to be deformed in accordance with the invention immediately thereafter. The manufacturing speed is not reduced, or is only reduced to an insignificant extent, compared to the production of a packing without a modified edge region.

The invention and further details of the invention are explained in more detail in the text which follows on the basis of the exemplary embodiment illustrated in the drawing, in which the FIGURE shows a plan view of an installation for producing a metal packing sheet in accordance with the invention.

The FIGURE shows an installation for producing metal packing sheets. A large number of metal packing sheets of this type, after they have been structured, are arranged parallel to one another in order to produce an ordered packing.

The starting material used is a perforated aluminium sheet 1. The aluminium sheet 1 is unwound from a coil and fed to a first deformation unit 2. In the deformation unit 2, the aluminium sheet is provided with a, for example, triangular or sinusoidal corrugation. The metal sheet 1 may be corrugated either by means of a ram-like deformation tool or by means of a rolling process.

In the case of the former process, the metal sheet 1 is fed in steps to the deformation unit 2, then the corrugation is stamped into the metal sheet by means of the ram-like deformation tool, and then the metal sheet is conveyed a certain distance further, so that the partial piece which has just been corrugated leaves the deformation unit and a partial piece which has not yet been corrugated enters the deformation unit.

The metal sheet 3 which leaves the deformation unit 2 has channels running obliquely, at a substantially constant angle of, for example, 45° or 60°, with respect to the metal-sheet edge 4. The corrugation extends over the entire width of the metal sheet 3, i.e. from the metal-sheet edge 4 to the opposite metal-sheet edge 5.

According to the invention, the aluminium sheet 1 is deformed in two steps. Therefore, downstream of the first deformation unit 2 there is a deformation tool 6 for modifying the structure of the metal sheet 3 which has already been corrugated. For this purpose, the corrugated metal sheet 3 is processed by the deformation tool 6 in a narrow edge region along the metal-sheet edge 4, which amounts to approximately 1 to 5% of the total width of the metal sheet 1, 3.

The deformation tool 6 is designed as a type of ram which is pressed onto the metal sheet 3 and modifies the existing structure of the metal sheet 3. The deformation tool 6 modifies the edge region along the edge 4, in such a way that the angle of inclination of the channels of, for example, approximately 45° or 60° merges gradually, i.e. with a technically feasible radius, into an angle of approximately 90° with respect to the metal-sheet edge 4.

On leaving the deformation unit 6, the result is a structured metal sheet 7 which, over the majority of its width, has a corrugation with a constant angle of inclination of 45° or 60° with respect to the metal-sheet edge 4, but in an edge strip along the edge 4 has been modified in such a way that the angle of inclination of the channels gradually merges to a right angle.

Then, with the aid of the cutting blade 8, partial pieces 9 are cut off from the metal sheet 7 so as to match the desired size of the metal packing sheet. It is preferable for a partial piece 9 to be cut off at the same time as the ram 6 is being pressed onto the metal sheet 3. This means that the cycle rate of the metal packing sheet production is not affected by the additional modification in accordance with the invention. A metal packing sheet which has been deformed in two steps in accordance with the invention can therefore be produced just as quickly as a conventional metal packing sheet which has been structured in just a single deformation step.

It is also possible to deform not just the strip along the edge 4, but rather both edge regions along the metal-sheet edges 4 and 5. In this case, a further deformation unit may be connected downstream of or in parallel with the deformation unit 6, in order to deform the edge region adjoining the sheet edge 5. In this case, it is preferable for the deformation unit 6 and the further deformation unit to act on the sheet simultaneously, in order not to reduce the cycle rate of production. In general terms, it is expedient if all the apparatuses which do not operate continuously as far as possible act simultaneously on the sheet—generally on different partial pieces or sections of the sheet.

To produce an ordered packing, a plurality of partial pieces 9 are arranged parallel to one another, with the channels of adjacent metal packing sheets 9, possibly with the exception of the edge region or regions, crossing one another. Packings of this type are used, for example, for mass and heat transfer in a rectification column of a low-temperature air fractionation installation.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 103 37 073.0, filed Aug. 12, 2004 is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A two step process for producing a profiled sheet comprising:

(1) engaging a sheet with (a) a roller having one or more of profiled rolls or (b) a ram-like deformation tool having a generally horizontal sheet-engaging surface to provide a sheet with corrugations (4) which run obliquely with respect to the edges of the sheet with a substantially constant angle of inclination, and (2) deforming an edge region of the resultant corrugated sheet with a ram-like deformation tool (b) having a generally horizontal sheet engaging surface which is alternately brought into contact with the edge region and removed therefrom so as to provide the edge part with corrugation which runs at an angle of inclination with respect to the edge if the sheet which differs from said constant angle or inclination in step (1), said edge region constituting 1% to 10% of the entire sheet.

2. A process according to claim 1, wherein the sheet (1) is provided with the corrugations (3) by means of said ram-like deformation tool (2).

3. A process according to claim 1, wherein the sheet (1) is provided with the corrugations (3) by means of said roller.

4. A process according to claim 1, wherein the corrugation in step (2) is deformed in the edge region in such a way that its angle of inclination with respect to the sheet edge (4) which delimits the edge region is greater than the constant angle of inclination of the corrugation (3) in step (1).

5. A process according to claim 4, wherein the angle of inclination of the corrugation in the edge region amounts to more than 80°.

6. A process according to claim 5, wherein the angle of inclination in step (1) is about 45–60°.

7. A process according to claim 6, wherein the angle of inclination of corrugation in the edge region amounts to approximately 90°.

8. A process according to claim 7, wherein the sheet (1) is provided with the corrugations (3) by means of said roller.

9. A process according to claim 1, wherein two opposite edge regions of the sheet are deformed.

10. A process according to claim 1, wherein only one edge region of the sheet (3) is deformed.

11. A process according to claim 1, wherein the sheet is provided with perforations and/or fine profiling prior to the deformation of the edge region.

12. A process according to claim 1, wherein after the deformation of the edge region, a partial piece is cut off the sheet, with this cutting-off of the partial piece being carried out at the same time as the deformation of an edge region.

13. A process for producing an ordered packing, according to claim 1, in which at least one edge region of a corrugated sheet is deformed, and further comprising arranging a multiplicity of sheets which have been deformed in this manner parallel to one another, by means of a ram-like deformation tool (6) which is alternately brought into contact with the edge region and removed from the edge region.

14. A process according to claim 13, wherein first of all the edge region of the sheet (3) is deformed, then partial pieces (9) are cut off the sheet, and then the partial pieces are arranged parallel to one another.

15. A process according to claim 1, wherein the entire sheet is corrugated in accordance with step (1).

16. A process according to claim 1, wherein the edge region is not subjected to corrugations according to step (1).

17. A process according to claim 1, wherein the edge region constitutes 1% to 5% of the sheet.

18. A process according to claim 1, wherein the ram-like defamation tool deforms the edge region over a length of 0.5 and 1.5 m.

19. A process according to claim 1, wherein said sheet is an aluminum sheet.

* * * * *